US009432781B2

(12) United States Patent
Herscher

(10) Patent No.: US 9,432,781 B2
(45) Date of Patent: Aug. 30, 2016

(54) WIRELESS CONTROL SYSTEM FOR PERSONAL COMMUNICATION DEVICE

(71) Applicant: Bret Herscher, Cupertino, CA (US)

(72) Inventor: Bret Herscher, Cupertino, CA (US)

(73) Assignee: EARGO, INC., Mountain View, CA (US)

( * ) Notice: Subject to any disclaimer, the term of this patent is extended or adjusted under 35 U.S.C. 154(b) by 44 days.

(21) Appl. No.: 14/229,947

(22) Filed: Mar. 30, 2014

(65) Prior Publication Data

US 2014/0301583 A1 Oct. 9, 2014

Related U.S. Application Data

(60) Provisional application No. 61/809,554, filed on Apr. 8, 2013.

(51) Int. Cl.
*H04R 25/00* (2006.01)

(52) U.S. Cl.
CPC ..... *H04R 25/554* (2013.01); *H04R 25/55* (2013.01); *H04R 25/552* (2013.01); *H04R 25/556* (2013.01); *H04R 25/558* (2013.01)

(58) Field of Classification Search
CPC .. H04R 25/55; H04R 25/552; H04R 25/554; H04R 25/556; H04R 25/558
USPC ..... 381/315
See application file for complete search history.

(56) References Cited

U.S. PATENT DOCUMENTS

| | | | | |
|---|---|---|---|---|
| 4,594,591 | A * | 6/1986 | Burke | G06K 13/0825 340/3.71 |
| 4,893,333 | A * | 1/1990 | Baran | G09B 7/00 358/403 |
| 6,115,478 | A | 9/2000 | Schneider | |
| 2003/0064746 | A1 | 4/2003 | Rader et al. | |
| 2005/0283207 | A1 | 12/2005 | Hochmair et al. | |
| 2007/0195978 | A1 | 8/2007 | Fink et al. | |
| 2007/0279237 | A1 | 12/2007 | Julian et al. | |
| 2007/0281721 | A1 | 12/2007 | Lee et al. | |
| 2010/0046443 | A1 | 2/2010 | Jia et al. | |
| 2011/0121968 | A1* | 5/2011 | Hart | G08B 7/06 340/540 |
| 2013/0016861 | A1 | 1/2013 | Kaemf | |

* cited by examiner

*Primary Examiner* — Duc Nguyen
*Assistant Examiner* — Sean H Nguyen
(74) *Attorney, Agent, or Firm* — Francis Law Group

(57) ABSTRACT

A wireless asymmetrical control system for a personal communication device comprising a first receiver associated with the personal communications device, and a transmitter having an in-band (IE audible) signal device, the IE audible device being configured to generate and transmit a time modulated control signals, the time modulated control signals being generated by generating a first plurality of multi-frequency signals comprising a plurality of first time modulated frequency combinations, and applying the plurality of first time modulated frequency combinations to a first plurality of control signals in a first frequency domain, the receiver being configured to decode the time modulated control signals and generate and transmit response signals to the IE audible signal device in response to the time modulated control signals, each of the response signals comprising an ultra-wide band (UWB) electro-magnetic pulse.

19 Claims, 3 Drawing Sheets

WIRELESS CONTROL SYSTEM FOR PERSONAL COMMUNICATION DEVICE

CROSS-REFERENCES TO RELATED APPLICATIONS

This application claims the benefit of U.S. Application No. 61/809,554, filed on Apr. 8, 2013.

FIELD OF THE INVENTION

The present invention generally relates to the field of personal communication devices. More particularly, the present invention relates to apparatus, systems and methods for processing, transmitting and receiving control signals to and from personal communication devices; particularly, hearing devices, and devices employing same.

BACKGROUND OF THE INVENTION

Hearing loss characteristics are highly individual and hearing thresholds vary substantially from person to person. The hearing loss varies from frequency to frequency, which is typically reflected by a clinical audiogram. Depending on the type and severity of hearing loss (sensorineural, conductive or mixed; light, moderate, severe or profound), the sound processing features of the human ear are compromised in different ways and require different types of functional intervention, from simple amplification of incoming sound as in conductive hearing losses to more sophisticated sound processing and/or using non-acoustic transducers as in the case of profound sensorineural hearing losses.

Hearing devices or aids are often employed to address hearing deficiencies. Conventional hearing aids capture incoming acoustic signals, amplify the signals and output the signal through a loudspeaker placed in the external ear channel. In conductive and mixed hearing losses an alternative stimulation pathway through bone conduction or direct driving of the ossicular chain or the inner ear fluids can be applied via bone conductive implants or middle ear implants.

Bone conductive implants aids resemble conventional acoustic hearing aids, but transmit the sound signal through a vibrator to the skull of the hearing impaired user. Middle ear implants use mechanical transducers to directly stimulate the middle or the inner ear.

In sensorineural hearing losses deficits in sound processing in the inner ear result in an altered perception of loudness and decreased frequency resolution. For example, to compensate for the changes in loudness perception less amplification is typically provided for high-level sounds than for low-level sounds.

The core functionality of hearing aids in sensorineural hearing losses is thus (a) compensating for the sensitivity loss of the impaired human ear by providing the required amount of amplification at each frequency and (b) compensating for loudness recruitment by means of a situation dependent amplification.

In profound sensorineural hearing losses the only functional solution for the patients can be offered by cochlear implants (CI). Cochlear implants provide electric stimulation to the receptors and nerves in the human inner ear.

In the signal processing chain of a cochlear implant, the signal that is received by the microphone is processed in a similar fashion as in a hearing aid. A second stage then transforms the optimized sound signal into an excitation pattern for the implanted stimulator.

The core task of signal processing of hearing aids and an important part in the signal pre-processing of other hearing support systems comprises frequency-equalization filtering and amplification, as well as automatic gain control to provide the appropriate amount of loudness perception in all listening situations. In addition to these core tasks, the signal processing can, and often does, provide noise reduction, feedback reduction, sound quality enhancements, speech intelligibility enhancements, improved signal-to-noise ratio of sounds from specific directions (directional microphones, beam forming) and more.

Hearing aids and other hearing solutions not only need to modulate amplification to the individual hearing loss of the patient, but ideally also need to modulate the amount of amplification to the current sound environment. This is related to the phenomenon of loudness recruitment that is characteristic for sensorineural hearing losses.

As a result of loudness recruitment, greater amplification is typically required in soft listening situations than in loud listening situations. A slow adaptation of the amount of amplification to the sound environment, with time constants greater than 1 sec., is often referred to as "automatic volume control". The noted adaptation has the advantage of providing the correct amount of amplification without distorting the signal.

However, abrupt changes in the level of the input signal are usually not compensated for and can, and in many instances will, result in a painful sensation or the loss of important information that follows a loud event. Exemplar abrupt changes include sudden loud sounds (door bang), but they also occur when listening to two people talking simultaneously with one of the two persons being closer than the other.

The state-of-the-art approach to compensate for sudden changes in the input signal level is referred to as "automatic gain control" that employs short time constants. However, automatic gain control, i.e. fast changes of the signal amplitude, often cause a reduction of the audio quality.

Another drawback of prior art technology is that due to the necessity of custom hardware and custom chip development, most hearing aids are quite expensive. Further, hearing aids typically require specialized experts for parameter adjustments (hearing aid fitting). This fitting is typically performed by trained professionals like audiologists or ENT (ear, nose and throat) doctors on a PC with dedicated fitting software, which is normally provided by the manufacturer of the corresponding devices. Specialized expert knowledge is absolutely required to correctly adjust the parameters.

A further drawback of prior art technology is that digital hearing aids only allow a very limited number of manual adjustments by the hearing impaired person him/herself, i.e. the output volume control and, in some instances, the selection of one of a small number of predefined listening programs. Each of these programs comprises a set of parameters optimized for a specific listening situation.

In some instances, means are provided to control a hearing aid by a physical remote control (a hand held device or a wrist watch with remote control functionality), but the number of parameters that can be changed by these remote controls is limited.

Another drawback of prior art hearing aids and cochlear implants is that solutions to connect these devices to consumer electronics (TV, stereo, MP3 player, mobile phones) are cumbersome and expensive. Furthermore, conventional hearing aids are devoid of any means to connect the hearing aid to the Internet® and, if capable of communicating with Personal Digital Assistant (PDA) devices and mobile phones, the interaction is typically limited to the amplification of the voice signal during phone calls or the amplification of reproduced music.

Further, the software (firmware) that is typically employed in hearing aids is not upgradable. For a small number of hearing aids, firmware updates may be available, but these updates are not available on a frequent basis and, therefore, modifications to the signal processing are, in most instances, limited to parameter-based changes that have been anticipated when the device was manufactured.

The latest generation of state-of-the-art digital devices can allow for a simple communication between devices disposed in the left and right ear. However, this communication is limited to a low bit rate transfer of parameters, for example to synchronize parameters of the automatic gain control to avoid disturbing the spatial perception due to independent gains in the two devices. More advanced approaches that require access to the audio signal from the microphones at the left and right ear are not feasible with current technology.

Several apparatus and methods have thus been developed to address one or more of the above referenced disadvantages and drawbacks associated with conventional hearing aids. Illustrative are the apparatus and methods disclosed in U.S. Pub. Nos. 2009/074206, 2007/098115 and 2005/135644, and U.S. Pat. Nos. 6,944,474 and 7,529,545.

In U.S. Pub. No. 2009/074206 A1 a portable assistive listening system is disclosed that includes a fully functional hearing aid and a separate handheld digital signal processing device. The signal processing device contains a programmable DSP, an ultra-wide band (UWB) transceiver for communication with the hearing aid and a user input device. The usability and overall functionality of hearing aid can purportedly be enhanced by supplementing the audio processing functions of the hearing aid with a separate DSP device.

U.S. Pub. No. 2007/098115 discloses a wireless hearing aid system and method that incorporates a traditional wireless transceiver headset and additional directional microphones to permit extension of the headset as a hearing aid. The proposed solution contains a mode selector and programmable audio filter so that the headset can be programmed with a variety of hearing aid settings that can be downloaded via the Internet® or tailored to the hearing impairment of the patient. No flexible means are, however, available to easily adjust the signal processing parameters.

U.S. Pat. Nos. 6,944,474 and 7,529,545 disclose a mobile phone and means to modulate an individual's hearing profile, i.e. a personal choice profile and induced hearing loss profile (which takes into account the environmental noise), separately or in combination, to build the basis of sound enhancement. The signal input is either a speech signal from a phone call, an audio signal that is being received through a wireless link to a computer or multimedia content stored on the phone. While the sound environment is taken into account to optimize the perception of these sound sources, the sound environment itself is not the target signal. In contrast, the amplification is optimized in order to reduce the masking effect of the environmental sounds.

U.S. Pub. No. 2005/0135644 discloses a digital cell phone with built-in hearing aid functionality is disclosed. The device comprises a digital signal processor and a hearing loss compensation module for processing digital data in accordance with a hearing loss compensation algorithm. The hearing loss compensation module can be implemented as a program executed by a microprocessor. The proposed solution also exploits the superior performance in terms of processing speed and memory of the digital cell phone as compared to a hearing aid.

According to the disclosed methodology, the wireless download capabilities of digital cell phones provide flexibility to the control and implementation of hearing aid functions. In one embodiment, the hearing compensation circuit provides level-dependent gains at frequencies where hearing loss is prominent. The incoming digitized signal is processed by a digital filter bank, whereby the received signals are split into different frequency bands. Each filter in the filter bank possesses an adequate amount of stop-band attenuation. Additionally, each filter exhibits a small time delay so that it does not interfere too much with normal speech perception (dispersion) and production.

The use of a hierarchical, interpolated finite impulse response filter bank is also proposed. The outputs of the filter bank serve as inputs to a non-linear gain table or compression module. The outputs of the gain table are added together in a summer circuit.

A volume control circuit may be provided allowing interactive adjustment of the overall signal level. It is, however, noted that the audio signal captured during a phone call is used as the main input.

A further drawback associated with the disclosed wireless system, as well as most hearing aid systems, is that the wireless networks and/or protocols that are employed to transmit signals to/from the hearing aid, such as radio frequency (RF), Bluetooth® and Zigbee®, often provide limited data transmission and are often susceptible to interference.

Various wireless networks with associated protocols have thus been developed to provide accurate and reliable means to wirelessly transmit signals to/from hearing aids. Illustrative are the wireless networks disclosed in U.S. Pat. No. 7,529,565 and U.S. Pub. Nos. 2007/009124 and 2007/0259629.

U.S. Pat. No. 7,529,565 discloses a hearing aid comprising a transceiver for communication with an external device, wherein a wireless communication protocol having a transmission protocol, link protocol, extended protocol, data protocol and audio protocol is employed. The transmission protocol is configured to control transceiver operations to provide half duplex communications over a single channel. The link protocol is configured to implement a packet transmission process to account for frame collisions on the channel.

U.S. Pub. No. 2007/0009124 discloses a wireless network for communication of binaural hearing aids with other external devices, such as a smart phone, using slow frequency hopping, wherein each data packet is transmitted in a separate slot of a TDMA frame. Each slot is also associated with a different transmission frequency, wherein the hopping sequence is calculated using the ID of the master device, the slot number and the frame number. A link management package (LMP) is sent from the master device to the slave devices in the first slot of each frame.

According to the Applicants, the system can be operated in a broadcast mode, wherein each receiver is turned on only during time slots associated with the respective receiver. The system also includes two acquisition modes for synchronization, with two different handshake protocols. Eight LMP messages are transmitted in every frame during initial acquisition, and one LMP message is transmitted in every frame once a network is established. Handshake, i.e. bi-directional message exchange, is needed both for initial acquisition and acquisition into the established network.

During acquisition, a reduced number of acquisition channels is used, with the frequency hopping scheme being applied to these acquisition channels.

U.S. Pub. No. 2007/0259629 discloses a further wireless network, wherein an ultra-wide band link is employed to transmit audio signals from a main device, such as a mobile phone, to a peripheral device, such as a hearing aid. The signals are transmitted via the ultra-wide band link in very short pulses of 1 ns or less duration, which correspond to a transmission band width of about 500 MHz.

In order to reduce power consumption, the transceivers are operated in an inter-pulse duty cycling mode. In order to better match the peak current consumption from the battery during powered-on times, a capacitive element is charged when pulses are not being transmitted or received and is then discharged to power the transceiver when pulses are being transmitted or received.

There are, however, several drawbacks associated with the noted system. A major drawback is that the hearing aid still contains a significant additional transmitter whose sole purpose is to close the communications loop. It is the essence of the present invention is to greatly simplify or completely eliminate an additional transmitter within the hearing aid.

A further drawback associated with conventional hearing aids is limited battery life. This is particularly a major issue for users of partially implantable hearing aids, wherein the power required by the implanted component of the hearing aid is supplied by a battery of the external component. Battery life time in partially implantable hearing aids typically is on the order of one day.

While the battery of the external component of the hearing aid in principle can be replaced quiet easily, a spare battery needs to be available and, depending on the situation, the user of the hearing aid may not want to a attract attention when attempting to change the battery. Further, during replacement of the battery the hearing aid does not function, so that the user, depending on the degree of his hearing loss, may be more or less deaf. In particular, such temporary deafness will be very disturbing in daily life, especially for active people.

In principle, users of conventional electro-acoustic hearing aids encounter similar problems, but to a less prominent extent, since ear battery runtimes typically are more than one week and, except for profound losses, the users of electro-acoustic hearing aids typically have a certain level of residual hearing and speech understanding without electronic amplification.

Several systems and methods have thus been developed to modulate battery use and, thereby, life. Illustrative are the apparatus and methods disclosed in U.S. Pat. No. 6,904,156 and U.S. Pub. No. 2009/0074203.

U.S. Pat. No. 6,904,156 discloses an electro acoustic hearing aid, wherein the hearing aid audio amplifier is disabled when low battery voltage is sensed.

U.S. Pub. No. 2009/0074203 discloses an electro acoustic hearing aid, which is connected via an ultra wide band (UWB) link to another hearing aid worn at the other ear and to a belt-won external processing device and. The wireless transceiver of the hearing aid is configured to power-down when low battery power is detected. The hearing aid is also switched to a conventional analog amplifier mode when the hearing aid power is critically low.

One additional drawback associated with conventional (or prior art) hearing aids is that they are often unattractive and associated with age and handicaps. (This social phenomenon is often referred to as "stigmatization".) Even with the latest improvements of less visible devices, amongst the hearing impaired that both need and can afford hearing aids, the market penetration is only around 25%.

It would thus be desirable to provide apparatus, systems and methods for processing, transmitting and receiving control signals to and from personal communication devices; particularly, hearing devices, and devices employing same, that reduce or overcome one or more of the above noted drawbacks that are associated with conventional hearing devices.

It is therefore an object of the present invention to provide improved apparatus, systems and methods for processing, transmitting and receiving control signals to and from personal communication devices; particularly, hearing devices, and devices employing same that overcome one or more of the drawbacks that are associated with conventional hearing devices.

It is another object of the present invention to provide a highly asymmetrical or uni-directional communications system between a controlling device and at least one hearing aid device that is capable of executing a limited number of slow speed setting adjustments in a reliable manner without requiring complex transmission circuitry within the hearing aid devices.

It is another object of the present invention to further simplify the communications system described above by incorporating complex and reliable signaling protocols specifically designed to have the burden of the complexity encapsulated within the host device transceiver and the hearing aid receiver with the aim of greatly simplifying or completely eliminating the hearing aid transmitter element.

It is yet another object of the present invention to incorporate the operator's actions as a portion of the communications system with the aim of completely eliminating the hearing aid transmitter element, thereby significantly simplifying the hearing aid device and significantly reducing its power consumption.

SUMMARY OF THE INVENTION

The present invention is directed to apparatus, systems and methods for processing, transmitting and receiving control signals to and from personal communication devices; particularly, hearing devices.

In one embodiment of the invention, there is provided a wireless asymmetrical control system for a personal communication device comprising a first receiver associated with the personal communications device, and a transmitter, the transmitter comprising an in-band (IE audible) signal device, the IE audible device being configured to generate and transmit a time modulated control signals, the time modulated control signals being generated by generating a first plurality of multi-frequency signals comprising a plurality of first time modulated frequency combinations, and applying the plurality of first time modulated frequency combinations to a first plurality of control signals in a first frequency domain, each of the plurality of first time modulated frequency combinations comprising a different encoded frequency, the receiver being configured to decode the time modulated control signals and generate and transmit response signals to the IE audible signal device in response to the time modulated control signals, each of the response signals comprising an ultra-wide band (UWB) electro-magnetic pulse.

In some embodiments, the first time modulation comprises a framed time delay.

In some embodiments, the first time modulation comprises a frameless time delay.

In some embodiments, each of the response signals comprises a visible optical pulse.

In some embodiments, each of the response signals comprises an invisible optical pulse.

In some embodiments, the time modulated control signals have an initial signal level, and the transmitter is further configured to generate and repeatedly transmit at least one of the time modulated control signals until the IE audible signal device receives a first response signal from the receiver, the response signal representing receipt of at least one of the time modulated control signals.

In some embodiments, at least one of said plurality of time modulated control signals has an initial communications signal level and at least one of said re-transmitted time modulated control signals has a second signal level, said second signal level being greater than said initial communications signal level.

BRIEF DESCRIPTION OF THE DRAWINGS

Further features and advantages will become apparent from the following and more particular description of the preferred embodiments of the invention, as illustrated in the accompanying drawings, and in which like referenced characters generally refer to the same parts or elements throughout the views, and in which.

DETAILED DESCRIPTION OF THE PREFERRED EMBODIMENT

Figure 1:
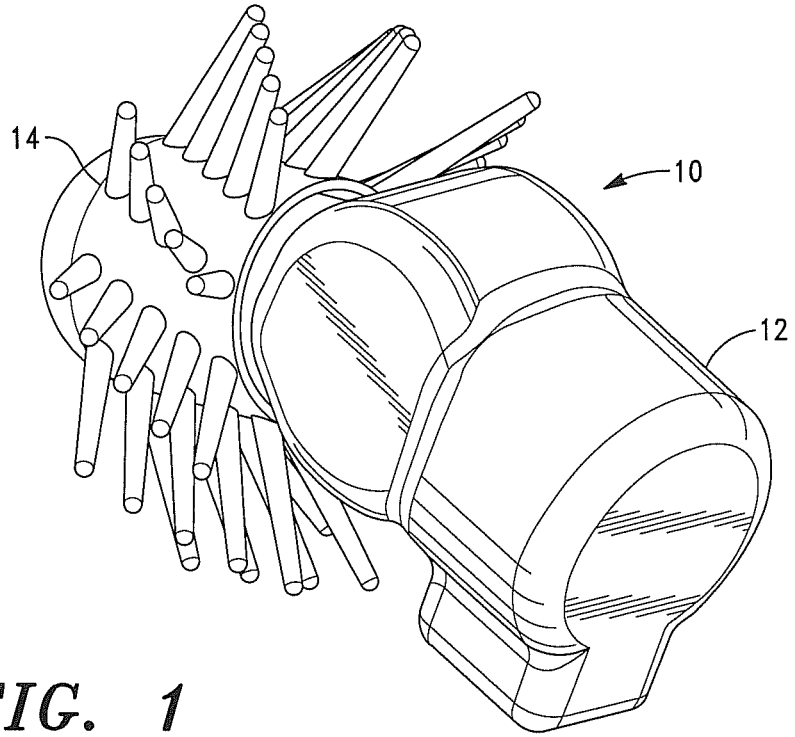
FIG. 1 is a perspective view of one embodiment of a personal communication device, i.e. a hearing aid, according to the invention.

Before describing the present invention in detail, it is to be understood that this invention is not limited to particularly exemplified apparatus, systems, structures or methods as such may, of course, vary. Thus, although a number of apparatus, systems and methods similar or equivalent to those described herein can be used in the practice of the present invention, the preferred apparatus, systems, structures and methods are described herein.

It is also to be understood that, although the signal processing and transmission systems and methods of the invention are illustrated and described in connection with a hearing aid, the signal processing and transmission of the invention are not limited to hearing devices and systems. According to the invention, the signal processing and transmission of the invention can be employed on or with other personal communication devices.

It is also to be understood that the terminology used herein is for the purpose of describing particular embodiments of the invention only and is not intended to be limiting.

Unless defined otherwise, all technical and scientific terms used herein have the same meaning as commonly understood by one having ordinary skill in the art to which the invention pertains.

Further, all publications, patents and patent applications cited herein, whether supra or infra, are hereby incorporated by reference in their entirety.

Finally, as used in this specification and the appended claims, the singular forms "a, "an" and "the" include plural referents unless the content clearly dictates otherwise. Thus, for example, reference to "a signal" includes two or more such signals and the like.

DEFINITIONS

The terms "hearing aid" and "hearing prosthesis" are used interchangeably herein and mean and include any device or system that is adapted to amplify and/or modulate and/or improve and/or augment sound or acoustic signals transmitted to (or for) a subject.

The term "processing", as used herein in connection with received or transmitted signals, means and includes analyzing, encoding and decoding analog and digital signal data.

The term "processing means", as used herein, means and includes any analog or digital device, system or component that is programmed and/or configured to process signals, including, without limitation, a microprocessor and DSP.

The term "spectrally optimized signal", as used herein, means and includes a signal that has been adjusted or customized, i.e. tuned, for a specific subject.

The term "personal communication device", as used herein, means and includes any device or system that is adapted to receive transmitted signals representing sound via wireless or wired communication means.

The following disclosure is provided to further explain in an enabling fashion the best modes of performing one or more embodiments of the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

As will readily be appreciated by one having ordinary skill in the art, the present invention substantially reduces or eliminates the disadvantages and drawbacks associated with conventional hearing devices.

As indicated above, the present invention is directed to apparatus, systems and methods for processing, transmitting and receiving control signals to and from personal communication devices; particularly, hearing devices. In a preferred embodiment, transmission of signals to and from the hearing devices is achieved via a unique asymmetrical communication system.

Figure 2:
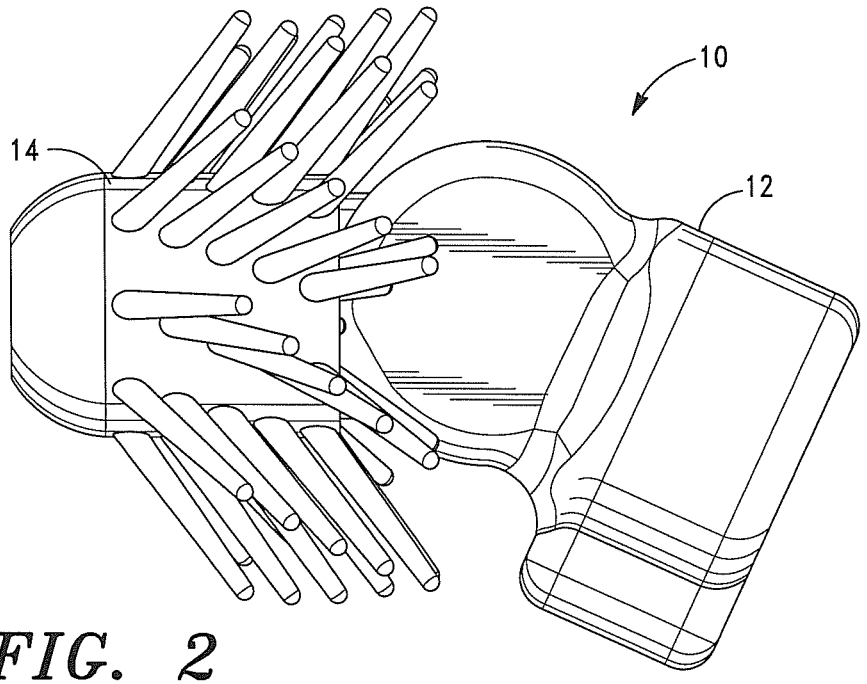
FIG. 2 is a side plan view of the personal communication device shown in FIG. 1, according to the invention.

Referring now to FIGS. 1 and 2, there is shown an exemplar hearing device or aid 10. As illustrated in FIGS. 1 and 2, the hearing aid 10, includes an outer housing 12 and a securing mechanism 14 disposed on at least an outer portion of the housing 12. As set forth in Co-Pending U.S. application Ser. No. 13/733,798, and U.S. Pat. Nos. 8,457,337 and 8,577,067, which are incorporated herein in their entirety, the securing mechanism 14 is configured to contact a surface of an internal space, e.g. ear canal, and secure the hearing aid 10 therein.

As also set forth in Co-Pending U.S. application Ser. No. 13/733,798, and U.S. Pat. Nos. 8,457,337 and 8,577,067, the securing mechanism 14 is further configured to provide at least one path for fluid flow therethrough.

As set forth in Co-Pending U.S. application Ser. No. 13/733,798 and will be readily appreciated by one having ordinary skill in the art, the hearing aid 10 provides accurate, virtually undetectable and comfortable fitment. The hearing aid 10, thus, substantially reduces, and in many instances eliminates, the serious "stigmatization" issue associated with conventional hearing aids.

Figure 3:
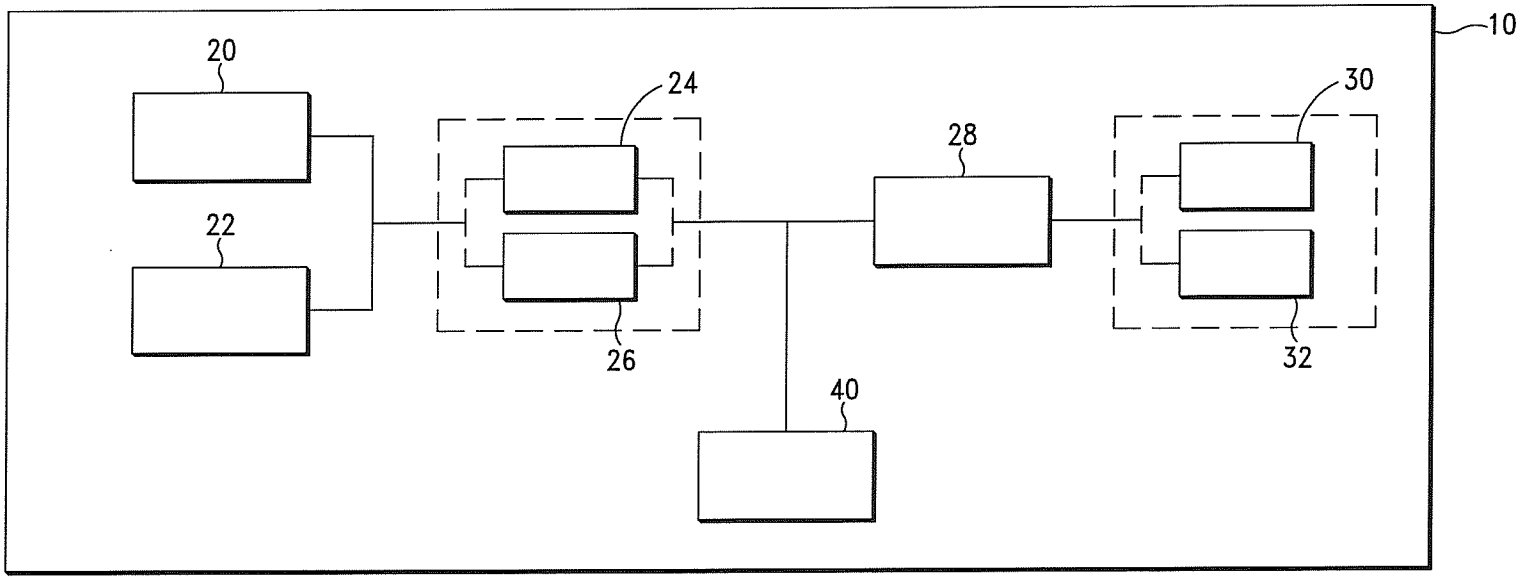
FIG. 3 is a schematic illustration of one embodiment of the components associated with the personal communication device shown in FIG. 1, according to the invention.

Referring now to FIG. 3, the hearing aid 10 also includes means for receiving wireless audio or acoustic (i.e. input) signals from at least one source 20, means for receiving wireless control signals from an external source, e.g., a smart phone 22, first programming means for generating at least one reconstructed acoustic signal from the received audio input signals 24, second programming means for generating at least one response signal (discussed in detail below) 26, memory means 28, means for transmitting at least one reconstructed acoustic signal to the ear unit(s) 30, and means for wirelessly transmitting at least one response signal to an external device, e.g., smart phone 32. As illustrated in FIG. 3, the hearing aid 10 further includes a power source 40.

Preferably, the first processing means is configured to process received audio input signals from an external sound or audio source (or multiple audio sources) and generate one or more reconstructed acoustic signals from the audio signals and/or control the transmission of the reconstructed acoustic signals to the subject. As set forth in Co-Pending application Ser. No. 13/942,908, which is also incorporated herein in its entirety, the reconstructed acoustic signals can comprise, without limitation, spectrally optimized signals, amplified audio signals, and enhanced audio signals, e.g. optimal signal-to-noise ratio.

As discussed in detail below, preferably, the second processing means is configured to analyze received control signals from an external source and generate at least one response signals therefrom, e.g., a signal representing receipt of a designated control signal, to the external source.

As indicated above, various signal protocols or variants have been employed to transmit control signals from an external device to a hearing aid. Such variants include radio frequency, e.g., Bluetooth®, Zigbee®, 802.11, 802.15.4, etc., light, e.g., infrared, visible, laser, etc., electromagnetic induction, and sound, e.g., ultrasound, audible sound, audio signals below 20 Hz, etc.

In some embodiments of the invention, at least one of the noted variants is employed to transmit control signals from an external device to the hearing aid. In a preferred embodiment of the invention, however, an ultra-wide band protocol is employed to transmit response signals from the hearing aid to the external device, i.e. an asymmetrical transmission protocol.

In some embodiments of the invention, the wireless transmission network comprises an in-band (IE audible) signaling mechanism, such as DTMF (Dual Tone Mult-Frequency) signaling. A common example of DTMF is the touch-tone signaling used within the telephone system. In Touch-tone, each numeric key transmits a combination of tones that can be decoded remotely using standard filters.

According to the invention, the touch-tone concept is expanded in three ways. First, the concept is expanded to multi-frequency signaling by using a large number of specific frequencies in combinations. By way of example, one embodiment of the invention incorporates frameless Frequency Shift Keying (FSK) where the frequency is modulated with a Pseudorandom Binary Sequence. The receiver in the hearing uses a frequency domain autocorrelator to detect the presence or absence of individual control commands.

Second, a time overlay is included, wherein correctly encoded control instructions have specific times associated with their presence/absence. In this scheme the signal is modulated over a predetermined period of time to both allow a multiplicity of commands to be identified and to increase the reliability of the communications.

As is well known in the art, generically, time overlays can be divided into two classes; framed and frameless.

In a framed time overlay the modulation is imposed relative to some framing event. Exemplary framing events are a pilot tone signal, true time (often derived from a GPS receiver) or the absence of modulated signal for a period of time (as in common asynchronous communications).

In a frameless time overlay, the modulation consists of a repetitive sequence of bits which by their repetitive nature permit the receiver to synchronize to the modulated signal. In some embodiments, this modulated sequence comprises a pseudorandom binary sequence, such as, by way of example a Maximum Length Sequence (MLS).

According to the invention, a time domain autocorrellator can be employed to identify the presence or absence of the frameless commands. A multiplicity of commands can be supported by a multiplicity of pseudorandom binary sequences with an individual autocorrelator for each command.

According to the invention, a command (or autocorrelation hit) is identified by their being a significantly higher output from the autocorrelation algorithm than is observed on average, where the input to each autocorrelator is essentially noise.

Third, commands are encoded using a sequence of the multiplicity of tones and, thereby, effectively playing a discordant song to encode each command. The receiver would thus be configured to simply detect the song.

Fourth, one embodiment of the invention uses a highly asymmetrical air interface. In the highly asymmetrical case, the receiver supplies the single bit of handshaking information that a command has been received and correctly decoded. Though a single bit can provide sufficient information for this asymmetrical air interface, more than one bits of handshaking information can be supplied by the receiver to provide additional information. The mechanism of transmission of this single bit of handshaking information may be an extremely power efficient mechanism.

Fifth, in a preferred embodiment of the invention, a unidirectional air interface is employed, wherein the transmitter repeats each command for a period of time considered to be long enough for the receiver to have a high probability of reception of the command. Commands are structured to have a single, non-iterative meaning (such as 'Set your volume to level 5') rather than an iterative meaning (such as 'increase your volume'). When no feedback is provided from the receiver to indicate that the command has been correctly received and decoded, so the transmitter simply repeats the command many times to improve the probability of reception. The receiver is further configured to progressively increase the carrier signal strength during this process to further improve the probability of correct reception.

An example of an extremely power efficient, highly-asymmetrical air interface mechanism is where the receiver transmits a single short time duration, high amplitude burst of radiation synchronously with the end of each decoded command sequence. If the transmitter synchronously detects the presence of one or more of these radiation bursts it ceases the repetition of the command with an arbitrarily high probability of correct execution of the command. The nature of this radiation burst could be the same as the nature of the command transmission, but it need not be so. For example, in one embodiment of the invention the commands might be transmitted as an audio signal and the handshaking signal might be a responsive audio burst.

In some embodiments of the invention, the information the handshaking signal uses a different transmission media. For example, the synchronous handshake can comprise a single high amplitude Ultra-WideBand (UWB) electro-magnetic impulse.

Alternatively, the handshaking signal could be a visible/and or invisible optical burst.

According to the invention, combinations of handshakes could also be employed.

In a preferred embodiment of the invention, the unidirectional air interface is construed by incorporating the user as a part of the handshaking mechanism. In these schemes the user takes a specific action which communicates to the transmitter that the command has been correctly decoded. There are a wide variety of ways in which this can be effected and several examples are provided below.

In just one example of this process, the user presses and holds a button on the transmitter (envisaged to be a smartphone) until he perceives that the command has been received correctly. The transmitter repeats the command until the user ceases pressing on the button. The transmitter can, if necessary, commence the repetition of the command at an extremely low carrier signal level and gradually increase the carrier signal level until such time as the user ceases holding the button. The receiver can also issue an audio prompt to the user each time it receives a correctly decoded command.

To further illustrate this process, the transmitter can include a screen with five buttons on it labeled "Volume 1" through "Volume 5". When the user presses and holds the button labeled "Volume 3" the transmitter commences transmitting the command to set the volume to level 3, starting at a low signal level and gradually increasing the signal level. After the receiver correctly decodes the command to set the volume to 3, it generates and transmits an audio snippet, which states "Volume Set to 3" through the earpiece of the hearing aid. When the user hears the audio snippet he releases the key on the transmitter. In this way, the command has been transferred to the hearing aid using the lowest possible carrier signal level.

The transmitter or a separate device in communication with the transmitter can communicate to the user to change orientation, position, or location of the transmitter relative the receiver or relative to the user or body part (e.g. ear) of the user if one or more commands from the transmitter is not acknowledged. Said communication to the user can be used in combination with commands from the transmitter of non-varying signal strength, varying signal strength, or when the maximum signal strength has been reached. Said communication to the user can be discontinued once acknowledgement of the command is received or when the user indicates that the effect of the command is not longer desired.

In some embodiments of the invention, the wireless transmission network comprises an inaudible sound field. According to the invention, one means of achieving the inaudible sound field is to employ the audio sampling system as a down-converting mixer. By way of example, in the Overtus® hearing aid DSP, the incoming audio is sampled at 16 kHz. This sampling will produce aliasing components, which are normally rejected with a simple digital filter.

For example, a strong 17 kHz tone will produce a 1 kHz aliasing tone after sampling at 16 kHz in a process of simple mixing. This mixing component is generally filtered out in a variety of ways before conversion. The most common method of filtering is to use a form of integrating converter, such as a delta-sigma converter, which inherently has a natural comb-like filter at the Nyquist frequency (IE at 8 kHz for a 16 kHz sample rate).

There is, however, a drawback associated with such an approach. The properties of a simple converter, i.e. IE inherent with no additional components, are generally non-ideal, because they have a comb-like response, rather than a true low pass response. This means that some in-band (IE audio) energy is available at the output when the system is stimulated above the sampling frequency.

Figure 4:
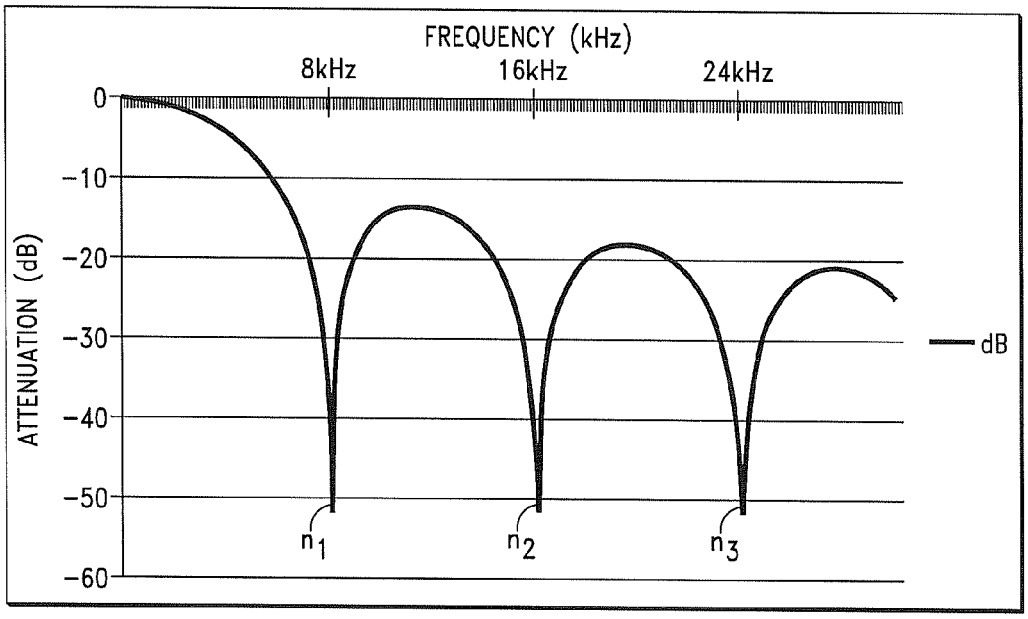
FIG. 4 is graphical illustration of a typical sine filter response.

Various simple filters are also available. However, such filters typically exhibit a response, as shown in FIG. 4. The nulls (denoted "$n_1$ thru $n_3$") occur at the sampling frequency. Some energy is thus down-converted at frequencies above the nulls.

A typical system addresses the non-ideality of the 'free' filter in two ways: (1) the system includes additional low pass filtering (typically just one-pole for simplicity); and (2) the system is configured to rely on the fact that there isn't a strong and coherent low ultrasound signal present in the general sound field. Thus, in the presence of a strong, coherent low ultrasound signal (LUS) a down-converted component will be present, which can be used for signaling. However, to employ the down-converted component for signally purposes, the down-converted component must be distinguished (and isolated) from the normal, in-band (IE audio) stimulus.

In a preferred embodiment of the invention, two techniques are employed to distinguish and isolate the down-converted component from the normal, in-band (IE audio) stimulus.

The first technique comprises time modulation of the low-ultrasound signal. According to this technique, when the LUS is turned off, the down-converted energy due to the LUS is removed from the output. When the LUS is turned on, the output comprises the (vector) sum of the in-band energy plus the down converted parasitic energy. With knowledge of the modulation frequency, the receiver can be configured to provide a time based demodulation superimposed on the detector to improve the specificity of the detector.

To illustrate the low-ultrasound concept, an expansion of the very specific example above is provided. As before, in this specific example the transmitter has a screen with five buttons on it labeled "Volume 1" through "Volume 5". The user presses and holds the button labeled "Volume 3". The transmitter then commences transmitting the command to set the volume to level 3, which, in this specific example, is chosen to be the simple short pseudorandom binary sequence of 17 kHz on for 50 ms, followed by silence for 50 ms followed by 18 kHz on for 100 ms followed by silence for 50 ins. According to the invention, the transmitter starts this cycle at a low signal level and repeats it at progressively higher and higher signal levels as long as the button is held down.

The receiver is configured to continuously sample the audio at 16 kHz and the audio output is fed to an autocorrelator in the receiver, which is designed to detect the simple short pseudorandom binary sequence of 1 kHz on for 50 ms, followed by silence for 50 ms followed by 2 kHz on for 100 ms followed by silence for 50 ms, which is the down converted output of the LUS signal when mixed down by the 16 kHz sampling converter. Whenever the autocorrelator output increases relative to it's ambient output, the volume level is set to level 3 in the hearing aid and the hearing aid additionally plays an audio snippet which says "Volume Set to 3" through the earpiece of the hearing aid. The user hears the audio snippet through the earpiece and he releases the key on the transmitter. In this way, the command has been transferred to the hearing aid using the lowest possible LUS signal level.

The second technique comprises frequency modulation of the low-ultra-sound energy, wherein the filter response of the receiver is employed as a fingerprint for the system. By modulating the frequency of the LUS, a well defined response is provided, which comprises the convolution of the low ultra-sound song that is being played and the filter response of the system.

According to one embodiment of the invention, in practice, the transmitter will thus play a low-ultrasound (LUS) song consisting of a series of precisely defined LUS tones for precisely defined durations. The receiver includes a software detector that is matched to the down-converted (IE audio) version of that song as it modified by the system filter. When the song is heard a particular command is executed. According to the invention, different songs are employed to encode different commands.

In a preferred embodiment, the lowest signal level which generates a reliable signaling system is employed. How low of a level that can be used will be dependent on the specifics of the hearing aid and transmitter. Ideally, the signal strength of a mobile phone would be sufficient to generate a satisfactory LUS song without any additional transducer.

As will readily be appreciated by one having ordinary skill in the art, the filter response of the transmitter (IE phone) is an integral component of the filter response of the system. This is particularly true if the output stage (including speaker) of the phone is employed as the LUS transducer. This means that different phones playing the same song will generate different songs at the receiver. It is not, however, desired that the receiver be configured to determine what type of transmitter is being used, i.e. which phone.

In some embodiments, this is achieved by pre-compensating the song in the transmitter, i.e. different transmitters (phones) have different songs that are generated, but these different songs produce the same response in the receiver. For example, if one phone has a flat output response and another has a 1-pole low pass filter response, the system is configured to apply the appropriate adjustment to the song in one relative to the other to produce the same LUS sound field.

In some cases, the filter response of the transmitter is known to the system. In other cases, the system may be used to calibrate or determine sufficient information about the filter response of the transmitter. Such calibration or characterization of the filter response can be achieved by transmitting one or more reference commands to the receiver at one or more frequency bands at given output levels. Depending on the whether the receiver responds or based on the nature of the response, the transmitter can determine information about the filter response of the transmitter. A separate calibration step or set of calibration commands can be used for this purpose. Such a calibration step can also be used to calibrate or characterize the frequency response of the transmitter and receiver system or transmitter, receiver, and user system, as the frequency response of the receiver, and the effect of the user and the relative location, position, and orientation of the user, receiver, and transmitter may affect the overall frequency response. In one example, the shape of the user's outer ear or ear canal and the depth of the receiver may affect the receipt of signals from the transmitter.

In some embodiments of the invention, audio signally is employed. As is well known in the art, human perception of audio requires a multiplicity of audio cycles for the human brain to be able to perceive distinct tones. Any audio waveform with a duration greater than approx. 20 ms, which contains rapid changing of frequency and/or continuous frequency hopping, is perceived by the human ear as a purely fricative stimulus and sounds like a click, such as is made by a mechanical switch or pushbutton.

In some embodiments of the invention, a limited set of control commands are generated with a selected set of frequency hopped or spread spectrum audio tones lasting no longer than a few hundred milliseconds. The noted tones will thus be perceived by the human ear as a fricative click, as would be appropriate for animating a soft keypad. All the clicks would be perceived to be essentially the same, but could actually encode a reasonably large amount of digital information.

Since the perceived waveform is being sampled at 16 kHz and digitized in its entirety, all the transmitted information is preserved and can be decoded, irrespective of the human ear/brain being able to distinguish the information. This means that a wide range of digitally quite distinct messages can be generated and transmitted audibly; all of which are perceived identically by the human ear as a click stimulus.

An embodiment of the present invention may be used as an aid to the user to determine the location of the receiver, for example, when a user loses a hearing aid. The transmitter can output a command and listen of a response from the receiver. If a response to the command issued by the receiver and the response is detected, it can be determined that the transmitter is within communication distance to the receiver. The transmitter can also transmit at lower signal strengths to decrease the communications distance and help the user converge on the location of the receiver. The user may also be able to hear the response from the receiver as an aid to determining its location. The same benefits of asymmetric communication and low power consumption of the receiver allow for such location detection methods to work with a low power device with limited energy or for longer periods of time.

As will readily be appreciated by one having ordinary skill in the art, the present invention provides numerous advantages compared to prior art signal processing methods and devices employing same. Among the advantages are the following:

- The provision of highly asymmetrical communication links between a personal communication device, e.g. hearing aid, and a controlling device that is capable of executing a limited number of slow speed setting adjustments in a reliable manner without requiring complex transmission circuitry within the hearing aid devices.
- The provision of highly asymmetrical communication links between a personal communication device, e.g. hearing aid, and a controlling device that incorporate complex and reliable signaling protocols and, hence, the burden of the complexity associated therewith, within the controlling device and the hearing aid, which greatly simplifies and/or completely eliminates the need for a hearing aid transmitter element.

Without departing from the spirit and scope of this invention, one of ordinary skill can make various changes and modifications to the invention to adapt it to various usages and conditions. As such, these changes and modifications are properly, equitably, and intended to be, within the full range of equivalence of the invention.

What is claimed is:

1. A wireless asymmetrical control system for a personal communication device, comprising:

a receiver configured to continuously detect and receive audio signals, said audio signals comprising first acoustic signals and second system control signals, said first acoustic signals comprising acoustic signals from an external source, said receiver comprising an autocorrelator that is configured to detect said second system control signals, said receiver being further configured to continuously receive said system control signals without interrupting said receipt of said first acoustic signals; and a transmitter configured to generate a plurality of time modulated control signals, said plurality of time modulated control signals being generated by generating a plurality of multi-frequency signals comprising a plurality of time modulated frequency combinations, and encoding said plurality of time modulated frequency combinations into a plurality of first control signals in a frequency domain, each of said plurality of time modulated frequency combinations comprising a different encoded frequency, said receiver being further configured to continuously sample and decode said time modulated control signals and generate said second system control signals in response to said time modulated control signals, each of said second system control signals comprising a pseudorandom binary signal sequence, said pseudorandom binary signal sequence comprising a second acoustic signal comprising a first frequency comprising 1 kHz over a first time duration of 50 ms, a first null over a second time duration of 50 ms, a third acoustic signal comprising a second frequency comprising 2 kHz over a third time duration of 100 ms, and a second null over a fourth time duration of 50 ms, wherein said autocorrelator detects said second system control signals, and wherein, in response to said second system control signals, at least a first device parameter is modulated.

2. The control system of claim 1, wherein said first time modulation comprises a framed time delay.

3. The control system of claim 1, wherein said first time modulation comprises a frameless time delay.

4. The control system of claim 1, wherein said transmitter is further configured repeatedly transmit at least one of said plurality of time modulated control signals to said receiver until said transmitter receives a response signal from said receiver in response to said at least one of said plurality of time modulated control signals, said response signal representing receipt of said at least one of said plurality of time modulated control signals.

5. The control system of claim 4, wherein a first transmitted at least one of said plurality of time modulated control signals has a first signal level and a second transmitted at least one of said time modulated control signals has a second signal level, said second signal level being greater than said first signal level.

6. The control system of claim 5, wherein said transmitter is further configured to progressively increase said at least one of said plurality of time modulated control signal levels up to a pre-determined maximum level.

7. A wireless asymmetrical control system for a personal communication device, comprising:

a receiver configured to continuously detect and receive audio signals, said audio signals comprising first acoustic signals and second system control signals, said first acoustic signals comprising acoustic signals from an external source, said receiver comprising an autocorrelator that is configured to detect said second system control signals, said receiver being further configured to continuously receive said system control signals without interrupting said receipt of said acoustic signals; and a transmitter being configured to generate a plurality of time modulated control signals, said plurality of time modulated control signals being generated by generating a plurality of multi-frequency signals comprising a plurality of time modulated frequency combinations, and encoding said plurality of time modulated frequency combinations into a plurality of first control signals in a frequency domain, each of said plurality of time modulated frequency combinations comprising a different encoded frequency, said receiver being further configured to continuously sample and decode said time modulated control signals and generate said second system control signals in response to said time modulated control signals, each of said second system control signals comprising a pseudorandom binary signal sequence, said pseudorandom binary signal sequence comprising a second acoustic signal comprising a first frequency comprising 1 kHz over a first time duration of 50 ms, a first null over a second time duration of 50 ms, a third acoustic signal comprising a second frequency comprising 2 kHz over a third time duration of 100 ms, and a second null over a fourth time duration of 50 ms, wherein said autocorrelator detects said second system control signals, and wherein, in response to said second system control signals, at least a first device parameter is modulated, said transmitter being further configured to repeatedly transmit at least one of said plurality of time modulated control signals to said receiver until said transmitter receives a receiver response signal from said receiver in response to said at least one of said plurality of time modulated control signals, said receiver response signal representing receipt of said at least one of said plurality of time modulated control signals, said transmitter further comprising manual input means for providing at least one manual response signal representing that said second system control signal has been received by said receiver, said manual input means being configured to provide a first manual response signal upon actuation of said manual input means, said transmitter being further configured to generate and transmit a user response signal to a user of said personal communication device in response to said first manual response signal, said user response signal representing receipt of said second system control signal by said receiver.

8. The control system of claim 7, wherein said receiver response signal is transmitted to said transmitter by said receiver via actuation of a manual key by said user.

9. The control system of claim 7, wherein said manual response signal comprises an audio tone.

10. The control system of claim 7, wherein said manual response signal comprises a verbal audio message.

11. The control system of claim 7, wherein said first time modulation comprises a frameless time delay.

12. The control system of claim 1, wherein a first transmitted at least one of said plurality of time modulated control signals has a first signal level and a second transmitted at least one of said time modulated control signals has a second signal level, said second signal level being greater than said first signal level.

13. The control system of claim 12, wherein said transmitter is further configured to progressively increase said at least one of said plurality of time modulated control signal levels of said transmitted time modulated control signals to a pre-determined maximum signal level.

14. The control system of claim 1, wherein said transmitter comprises an audible (IE in-band) transmitter.

15. The control system of claim 1, wherein said transmitter comprises a low ultrasound IE inaudible ultrasound transmitter.

16. The control system of claim 7, wherein said transmitter comprises an audible (IE in-band) transmitter.

17. The control system of claim 7, wherein said transmitter comprises a low ultrasound IE inaudible ultrasound transmitter.

18. The control system of claim 4, wherein each of said receiver response signal comprises a visible optical pulse.

19. The control system of claim 4, wherein each of said receiver response signal comprises an invisible optical pulse.

* * * * *